US010293403B2

(12) United States Patent
Kao

(10) Patent No.: US 10,293,403 B2
(45) Date of Patent: May 21, 2019

(54) FULL-SERVO MULTI-AXIS INJECTION DEVICE FOR DIE-CASTING MACHINE

(71) Applicant: T-SOK CO., LTD., New Taipei (TW)

(72) Inventor: Kun-Szu Kao, New Taipei (TW)

(73) Assignee: T-SOK CO., LTD., New Taipei (TW)

( * ) Notice: Subject to any disclaimer, the term of this patent is extended or adjusted under 35 U.S.C. 154(b) by 123 days.

(21) Appl. No.: 15/475,146

(22) Filed: Mar. 31, 2017

(65) Prior Publication Data

US 2018/0281058 A1 Oct. 4, 2018

(51) Int. Cl.
*B22D 17/20* (2006.01)

(52) U.S. Cl.
CPC ..... *B22D 17/2061* (2013.01)

(58) Field of Classification Search
CPC ..... B22D 17/00; B22D 17/20; B22D 17/26; B22D 17/30; B22D 17/32; B22D 17/2015; B22D 17/2061
USPC ..... 164/303, 312, 316, 341, 342
See application file for complete search history.

(56) References Cited

U.S. PATENT DOCUMENTS 9,884,364 B2 * 2/2018 Abe et al. ..... B22D 17/32
2015/0290705 A1 * 10/2015 Nakatsuka ..... B22D 17/2015 164/312
2015/0352764 A1 * 12/2015 Nakamura et al. ..... B22D 17/2015 425/542

* cited by examiner

*Primary Examiner* — Kevin P Kerns
(74) *Attorney, Agent, or Firm* — Leong C. Lei

(57) ABSTRACT

A full-servo multi-axis injection device for a die-casting machine, including a main body, including a hollow frame, servo motor, screw rod, transmission unit, and injection unit, the servo motor being configured on a top of the frame, one end of the servo motor having a deceleration mechanism in connection with one end of the screw rod, another end of the screw rod being in connection with the transmission unit, another end of the transmission unit the injection unit, and the injection unit having at least one input and at least one output. Whereby, the servo motor drives the screw rod to rotate upon running, and the transmission unit converts the rotation of the screw rod to a vertical reciprocating movement.

4 Claims, 3 Drawing Sheets

FULL-SERVO MULTI-AXIS INJECTION DEVICE FOR DIE-CASTING MACHINE

TECHNICAL FIELD OF THE INVENTION

The present invention relates to an injection device, and more particularly to an injection device used in a die-casting machine, using a servo motor as a power source to allow molten metal to be poured in a mold.

DESCRIPTION OF THE PRIOR ART

Conventional die casting is pouring molten metal of better fusibility, such as aluminum, zinc, magnesium or copper alloy into a high heat-resistant metal mold in a fast high-pressure mechanical way, and then, solidifying it into shape rapidly by means of the lower temperature of the mold.

General high chamber die casting machines are mainly configured with a base, on which a mold is mounted, where an injection port is configured on one side of the mold, and a fusion furnace located beside the base. In addition, an oil cylinder is configured above the fusion furnace, and one end of the oil cylinder is in match connection with the injection port of the mold through a discharge head, thereby pouring molten metal into a high heat resistant metal mold fast, mechanically with high pressure. However, since either a gas cylinder or oil cylinder is used as a power source in conventional die casting machines, the movement stroke and speed can not be precisely controlled, and must be adjusted by experienced personnel. In addition, the oil cylinder will cause the working environment to be greasy.

SUMMARY OF THE INVENTION

In view of the shortcomings mentioned above, the main object of the present invention is to provide a full-servo multi-axis injection device for a die-casting machine, replacing a pneumatic cylinder or hydraulic cylinder with a servo motor, allowing an operation stroke to be more precise, capable of in response to various manufacturing methods because the servo motor can be set with a stroke, and without noise caused from the pneumatic cylinder and grease from the hydraulic cylinder.

To achieve the object mentioned above, the present invention proposes a full-servo multi-axis injection device for a die-casting machine, including a main body, including a hollow frame, servo motor, screw rod, transmission unit, and injection unit, the servo motor being configured on a top of the frame, one end of the servo motor having a deceleration mechanism in connection with one end of the screw rod, another end of the screw rod being in connection with the transmission unit, another end of the transmission unit the injection unit, and the injection unit having at least one input and at least one output.

The frame is further configured with a partition having a through hole for the insertion of the screw rod therein, and the screw rod a third fixing element in connection with the partition and having a bearing in connection with the screw rod; one side of the frame is opened with a position limiting hole, and one side of the transmission unit is configured with an engagement portion passed through the position limiting hole.

Whereby, the servo motor drives the screw rod to rotate upon running, and the transmission unit converts the rotation of the screw rod to a vertical reciprocating movement.

DETAILED DESCRIPTION OF THE PREFERRED EMBODIMENTS

Figure 1:
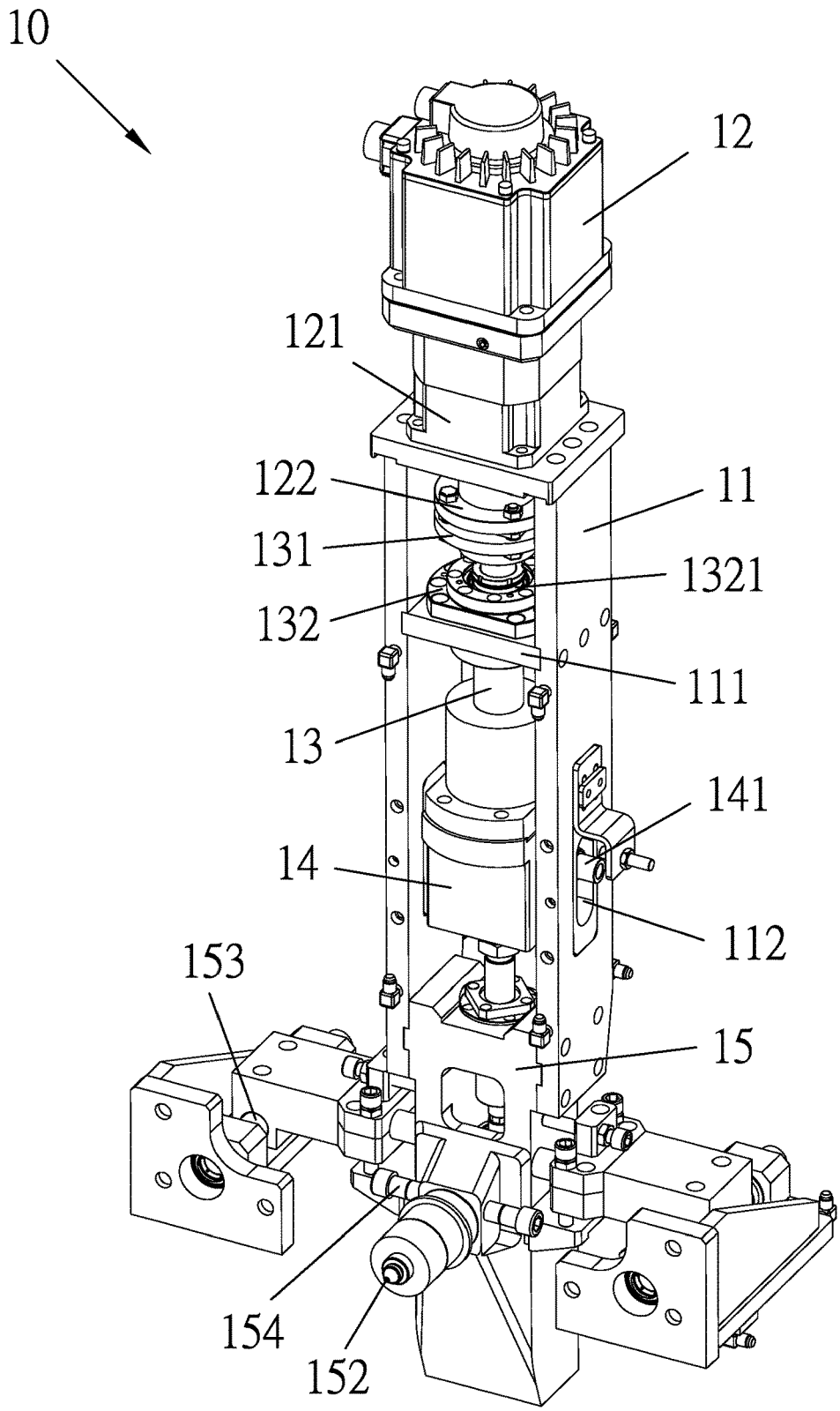
FIG. 1 is a perspective view of the present invention.
Figure 2:
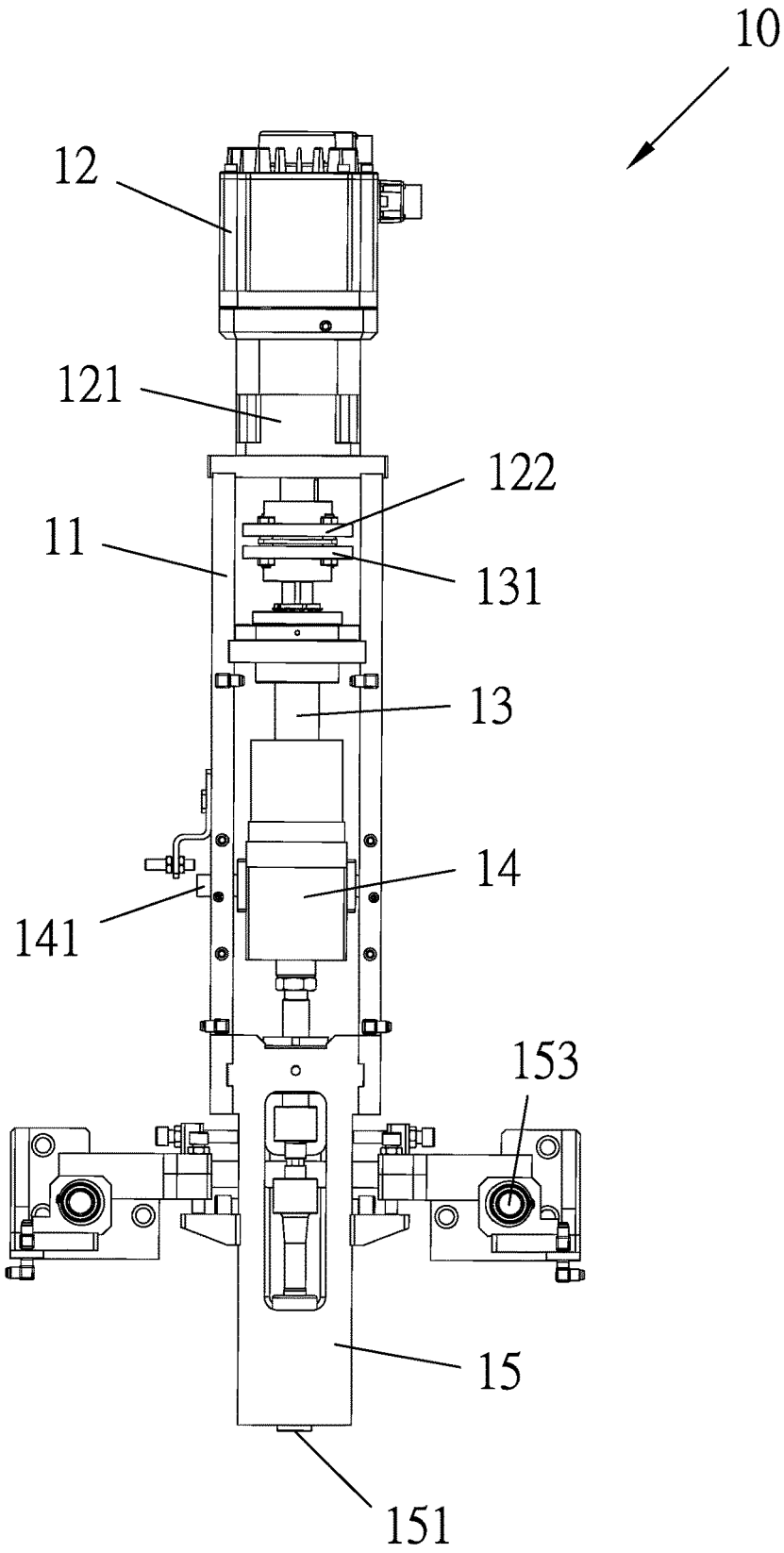
FIG. 2 is a rear view of the present invention.

Referring to FIGS. 1 and 2, a full-servo multi-axis injection device for a die-casting machine includes a main body 10.

The injection device 10 includes a hollow frame 11, servo motor 12, screw rod 13, transmission unit 14 and injection unit 15, where the servo motor 12 is mounted on the top of the frame 11, and one end of the servo motor 12 having a deceleration mechanism 121 in connection with one end of the screw rod 13, another end of which is in connection with the transmission unit 14, another end of which is coupled to the injection unit 15 having at least one input 151 and at least one output 152.

Figure 3:
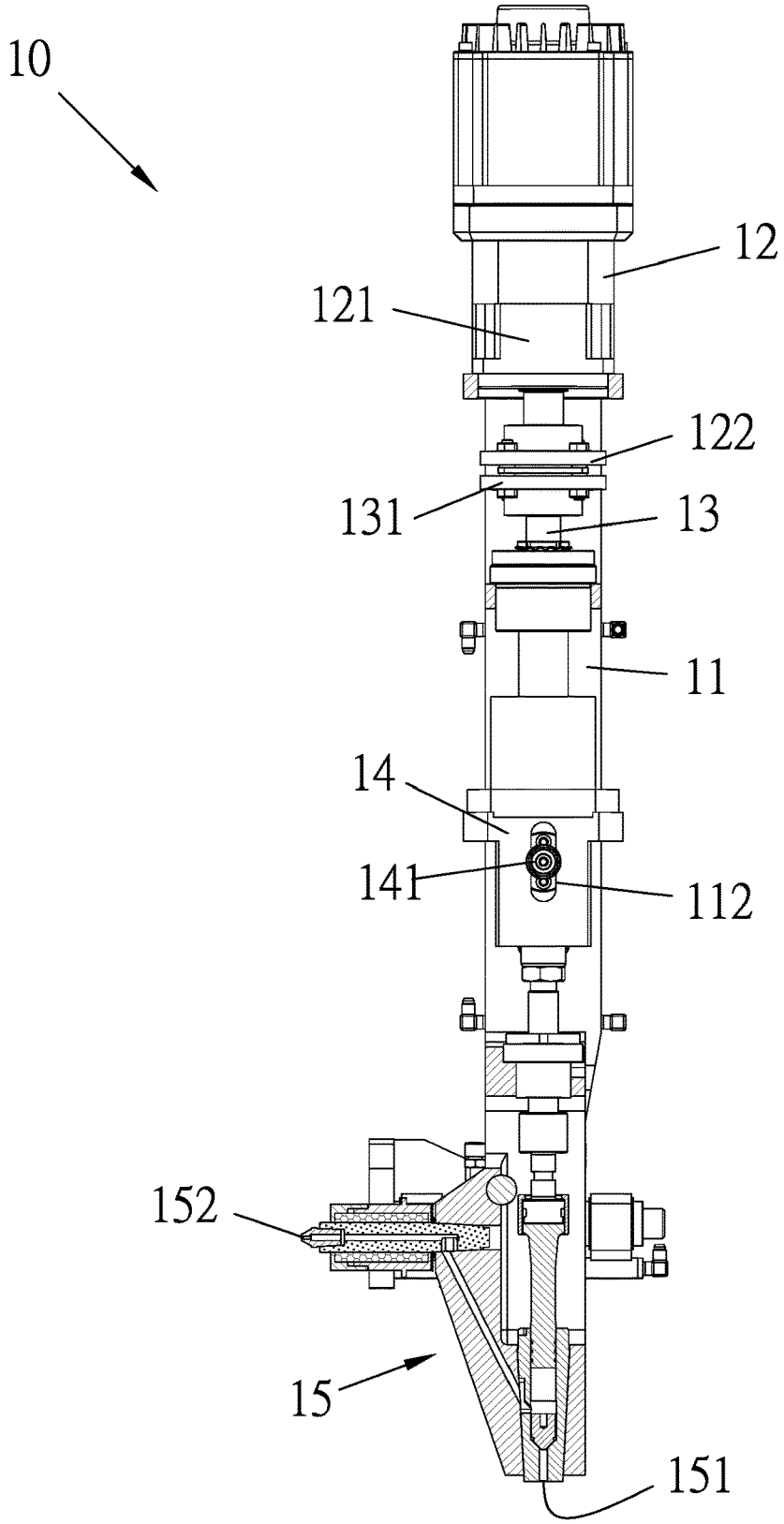
FIG. 3 is a cross-sectional view of the present invention.

Referring also to FIG. 3, a first fixing element 122 and second fixing element 131 in connection with each other are respectively configured on one end of the first deceleration mechanism 121 and one end of the screw rod 13, where the first fixing element 122 and second fixing element 131 respectively are a coupling, thereby coupling the first deceleration mechanism 121 to the screw rod 13.

A partition having a through hole (not shown in the figures) is further configured in the frame 11, and the screw rod 13 is passed through the through hole. Furthermore, the screw rod 13 is provided with a third fixing element 132 in connection with the partition 111, and a bearing 1321 in connection with the screw rod 13 is further configured on the third fixing element 132. Furthermore, a position limiting hole 112 is configured on one side of the frame 11, and an engagement portion 141 is projected from one side of the transmission unit 14, where the engagement portion 141 is passed through the position limiting hole 112.

Furthermore, the injection unit 15 is provided with a through hole (not shown in the figures) for the insertion of the screw rod 13 therein, and the input 151 and output 152 are respectively positioned on the bottom face and one side of the injection unit 15, with the two sides of the injection unit 15 being respectively configured slidably on a guide rail 153 and further respectively projected with a combination portion 154.

Thereupon, the servo motor 12 drives the screw rod 13 to rotate upon running, and the transmission unit 14 converts the rotation of the screw rod 13 to a vertical reciprocating movement through the structures mentioned above.

I claim:

1. A full-servo multi-axis injection device for a die-casting machine, comprising a main body, and further comprising a hollow frame, servo motor, screw rod, transmission unit, and injection unit, said servo motor being configured on a top of said frame, one end of said servo motor having a deceleration mechanism in connection with one end of said screw rod, another end of said screw rod being in connection with said transmission unit, another end of said transmission unit being coupled to said injection unit, and said injection unit having at least one input and at least one output; whereby, said servo motor drives said screw rod to rotate upon running, and said transmission unit converts rotation of said screw rod to a vertical reciprocating movement, wherein said injection unit is further configured with a through hole for insertion of said screw rod therein, and said at least one input and said at least one output are respectively configured on a bottom face and one side of said injection unit, and wherein two sides of said injection unit are further respectively configured slidably on a guide rail, and said two sides of said injection unit are respectively projected with a combination portion.

2. The injection device according to claim 1, wherein said deceleration mechanism and one end of said screw rod are respectively configured with a first fixing element and a second fixing element in connection with each other.

3. The injection device according to claim 1, wherein said hollow frame is configured with a partition provided with a first through hole for insertion of said screw rod therein, and said screw rod is provided with a third fixing element in connection with said partition and having a bearing in connection with said screw rod.

4. The injection device according to claim 1, wherein one side of said frame is provided with a position limiting hole, and one side of said transmission unit is projected with an engagement portion, said engagement portion being passed through said position limiting hole.

* * * * *